US007545346B2

(12) United States Patent
Hur et al.

(10) Patent No.: US 7,545,346 B2
(45) Date of Patent: Jun. 9, 2009

(54) PLASMA DISPLAY PANEL AND A DRIVE METHOD THEREFOR

(75) Inventors: Min Hur, Suwon-si (KR); Yoon-Hyoung Cho, Suwon-si (KR); Young-Do Choi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 604 days.

(21) Appl. No.: 11/133,216

(22) Filed: May 20, 2005

(65) Prior Publication Data

US 2005/0259048 A1 Nov. 24, 2005

(30) Foreign Application Priority Data

May 24, 2004 (KR) ..... 10-2004-0036820

(51) Int. Cl.
*G09G 3/28* (2006.01)

(52) U.S. Cl. ..... 345/60; 345/61; 345/62; 345/63; 345/64; 345/65; 345/66; 345/67

(58) Field of Classification Search ..... 345/60–67
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |

(Continued)

FOREIGN PATENT DOCUMENTS

| | | |
|---|---|---|
| JP | 02-148645 | 6/1990 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Richard Hjerpe
*Assistant Examiner*—Leonid Shapiro
(74) *Attorney, Agent, or Firm*—Robert E. Bushnell, Esq.

(57) ABSTRACT

A plasma display panel (PDP) includes first and second substrates provided in opposition to one another, address electrodes formed on the first substrate, barrier ribs mounted between the first and second substrates so as to define a plurality of discharge cells, phosphor layers formed in the discharge cells, first and second electrodes formed on the second substrate, and third electrodes mounted between the first and second electrodes at positions corresponding to the discharge cells. The first and second electrodes are positioned further from the second substrate than the third electrodes, and a spacing is provided between the first and second electrodes. A method for driving the PDP includes (a) applying a reset waveform to the third electrodes during a reset interval, (b) applying a scan pulse to the third electrodes during an address interval, and (c) applying a sustain discharge voltage alternately to the first and second electrodes during a sustain discharge interval.

13 Claims, 10 Drawing Sheets

U.S. PATENT DOCUMENTS

| | | | | |
|---|---|---|---|---|
| RE37,444 | E | 11/2001 | Kanazawa | |
| 6,380,677 | B1 | 4/2002 | Park et al. | |
| 6,411,031 | B1 * | 6/2002 | Ha et al. | 313/582 |
| 6,630,916 | B1 | 10/2003 | Shinoda | |
| 6,707,436 | B2 | 3/2004 | Setoguchi et al. | |
| 7,133,005 | B2 * | 11/2006 | Lee et al. | 345/60 |

FOREIGN PATENT DOCUMENTS

| | | |
|---|---|---|
| JP | 08-096714 | 4/1996 |
| JP | 2845183 | 10/1998 |
| JP | 2917279 | 4/1999 |
| JP | 2000-331615 | 11/2000 |
| JP | 2001-043804 | 2/2001 |
| JP | 2001-256894 | 9/2001 |
| JP | 2001-325888 | 11/2001 |
| JP | 2003-151449 | 5/2003 |
| JP | 2003-168373 | 6/2003 |
| KR | 1999-012587 | 2/1999 |
| KR | 2003-0035741 | 5/2003 |
| KR | 2003-0083564 | 10/2003 |
| KR | 10-2005-0099242 | 10/2005 |
| KR | 10-2005-0101904 | 10/2005 |

* cited by examiner

PLASMA DISPLAY PANEL AND A DRIVE METHOD THEREFOR

CLAIM OF PRIORITY

This application makes reference to, incorporates the same herein, and claims all benefits accruing under 35 U.S.C. §119 from an application for PLASMA DISPLAY PANEL AND A DRIVE METHOD THEREFOR earlier filed in the Korean Intellectual Property Office on 24 May 2004 and there duly assigned Serial No. 10-2004-0036820.

BACKGROUND OF THE INVENTION

1. Technical Field

The present invention relates to a plasma display panel (PDP) having a discharge cell structure that enhances the ability to obtain a high density display, and to a method of driving the PDP.

2. Related Art

A PDP is a display device that realizes the display of images through excitation of phosphors by plasma discharge. That is, vacuum ultraviolet (VUV) rays emitted from plasma obtained via gas discharge excite phosphor layers, which then emit visible red (R), green (G), and blue (B) light to thereby form images. The PDP has many advantages, including the ability to be made with large screen sizes of 60 inches or more, a thin profile of 10 cm or less, a wide viewing angle, good color reproduction due to the self-emissive nature of the PDP (as in the case of cathode-ray tubes), and high productivity and low manufacturing cost as a result of manufacturing processes that are simpler than those used for making liquid crystal displays. As a result, the PDP is experiencing increasingly widespread use in the home and in industry.

The PDP structure was developed in the 1970s. The most common configuration in use today is that of the triode surface discharge structure. The triode surface discharge structure includes a first substrate having two different types of electrodes positioned on the same surface and formed along a first direction, and a second substrate provided at a predetermined distance from the first substrate and having address electrodes formed along a second direction, which is substantially perpendicular to the first direction. A discharge gas is sealed between the first and second substrates. Discharge is controlled by scan electrodes, which are independently operated through connection to each line, and by address electrodes provided in opposition to the scan electrodes. Sustain discharge, which controls brightness, is realized by two electrode groups positioned on the same surface of one of the substrates.

Leading PDPs having a 42-inch screen and larger provide XGA (1024×768 pixels) resolution. Ultimately, the goal is to obtain full HD (high definition)-level resolution of 1920×1080 pixels. Discharge cell size must be reduced to realize full HD resolution (i.e., higher density is required).

In the PDP having a conventional triode surface discharge structure, reduction in the size of the discharge cells refers to a minimization of the length and area of the electrodes. However, such a reduction in dimensions results in a drop of brightness and efficiency, accompanied by an increase in discharge firing voltage. Accordingly, in order to increase the density of the PDP, the structure must be different from one in which addressing is performed through opposing discharge and sustain discharge through surface discharge.

SUMMARY OF THE INVENTION

In accordance with the present invention, a plasma display panel is provided with a discharge cell structure that is able to induce sustain discharge which occurs between pairs of discharge sustain electrodes as an opposing discharge in order to overcome discharge problems associated with reducing discharge cell size.

The plasma display panel includes: a first substrate and a second substrate provided in opposition to one another with a predetermined gap therebetween; a plurality of address electrodes formed on the first substrate along a first direction; a plurality of barrier ribs mounted in the gap between the first and second substrates so as to define a plurality of discharge cells; a plurality of phosphor layers formed in the respective discharge cells; a plurality of first and second electrodes formed on the second substrate along a second direction that is substantially perpendicular to the first direction, the first and second electrodes corresponding to each of the discharge cells; and a plurality of third electrodes mounted between the first and second electrodes at respective positions corresponding to the discharge cells. The first and second electrodes are positioned further from the second substrate than from the third electrodes, and a space is provided between the first and second electrodes so that the first and second electrodes oppose one another.

The first and second electrodes are formed on a layer different from a layer on which the third electrodes are formed.

The first and second electrodes have a length, along a direction perpendicular to the substrates, that is greater than a length along a direction parallel to the substrates.

The first and second electrodes are made of metal.

The plasma display panel further includes a first dielectric layer and a second dielectric layer, the first dielectric layer being formed on the second substrate and covering the third electrodes, the first and second electrodes being formed on the first dielectric layer, the second dielectric layer being formed so as to surround each of the first and second electrodes.

The thickness of the second dielectric layer, formed on a surface opposing the first and second electrodes, is less than the thickness of the second dielectric layer, formed on a surface facing the first and second electrodes to the first substrate.

The third electrodes include bus electrodes extending in the second direction and intersecting the discharge cells, and protruding electrodes extending from the bus electrodes toward the first and second electrodes, respectively.

The protruding electrodes include enlarged sections formed at ends thereof in proximity to the first and second electrodes.

The barrier ribs include first barrier rib members extending in the first direction, and second barrier rib members extending in the second direction and intersecting the first barrier rib members so as to independently define each of the discharge cells. Each of the first and second electrodes is mounted so as to extend over one of the second barrier rib members such that pairs of the discharge cells adjacent in the first direction share one of the first and second electrodes in common.

The first and second electrodes extend over areas corresponding to the discharge cells.

A drive method for the plasma display panel comprises the steps of: (a) applying a reset waveform to the third electrodes during a reset interval; and (b) applying a sustain discharge voltage alternately to the first and second electrodes during a sustain discharge interval. A scan pulse is applied to the third electrodes during an address interval between the reset interval and the sustain discharge interval.

During the address interval, a first voltage is applied to the first electrodes, and a second voltage that is greater than the first voltage is applied to the second electrodes.

During a first sub-interval of the sustain discharge interval, a sustain discharge pulse and a third voltage are applied to the first and second electrodes, respectively, and a fourth voltage that is greater than the third voltage is applied to the third electrodes. During a second sub-interval of the sustain discharge interval, a sustain discharge pulse is alternately applied to the first and second electrodes, and the third electrodes are biased with the fourth voltage.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Exemplary embodiments of the present invention will now be described with reference to the drawings.

Figure 1:
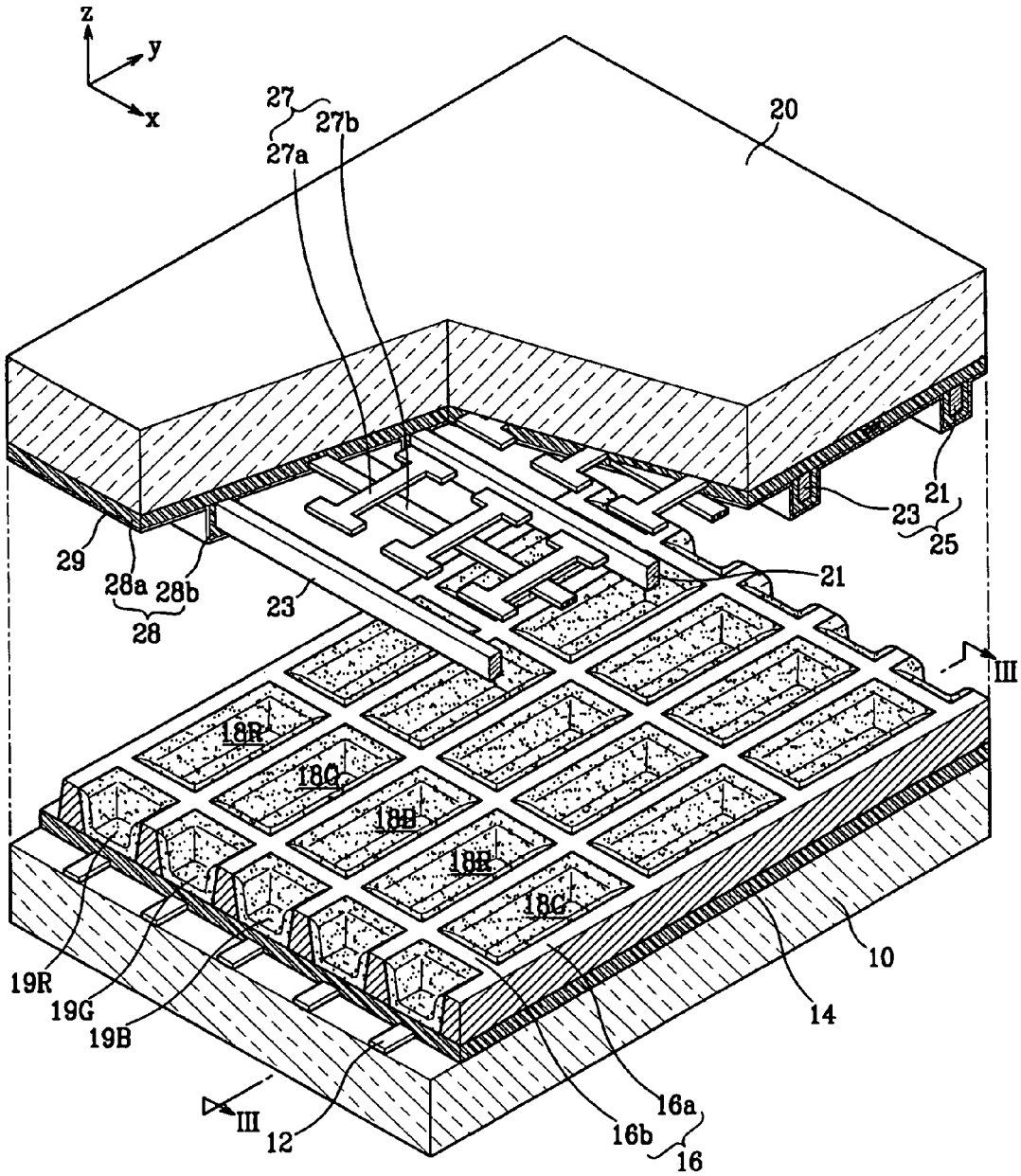
FIG. 1 is a fragmentary, sectional exploded perspective view of a plasma display panel according to a first exemplary embodiment of the present invention.
Figure 2:
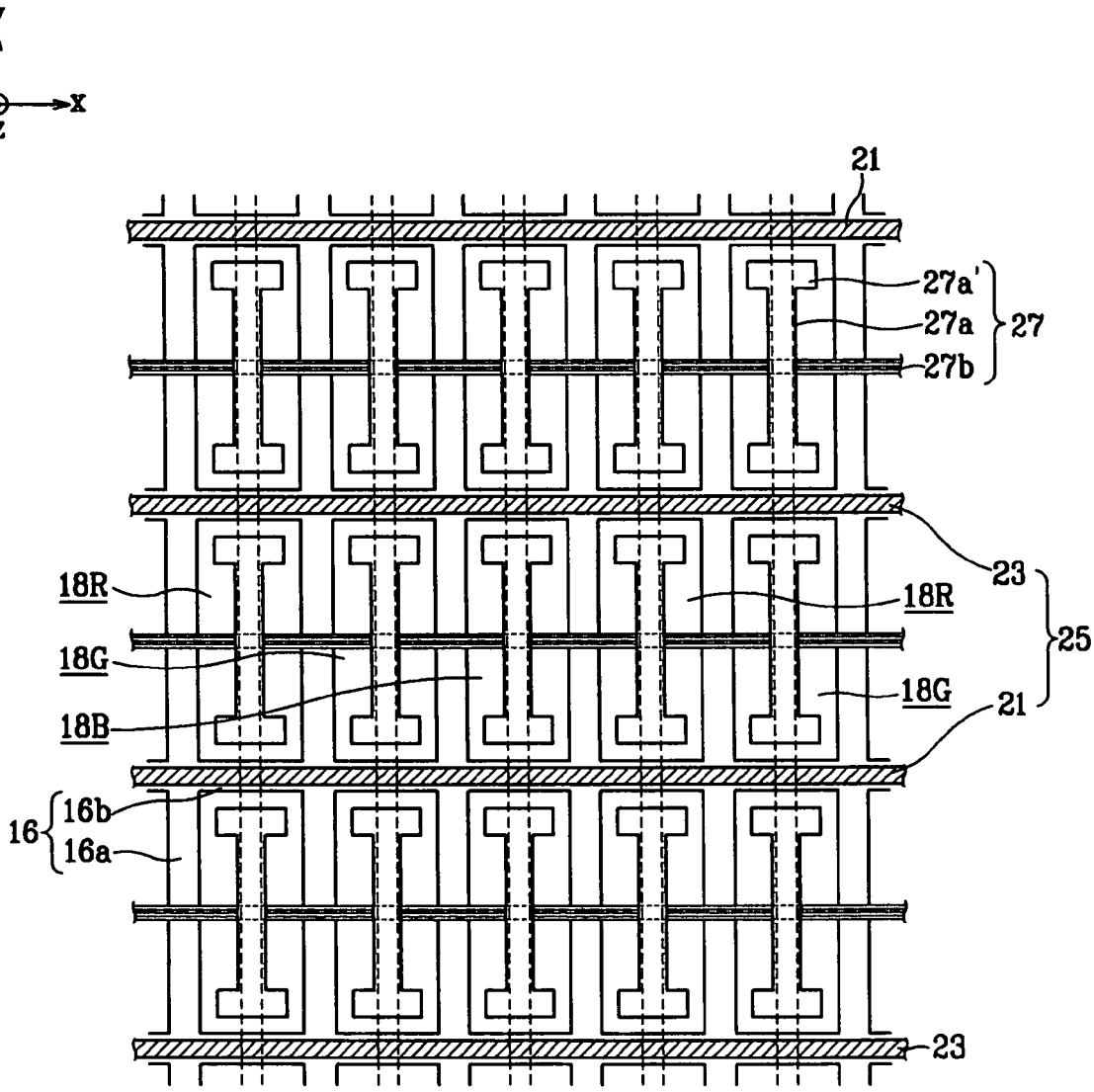
FIG. 2 is a fragmentary plan view of the plasma display panel of FIG. 1.
Figure 3:
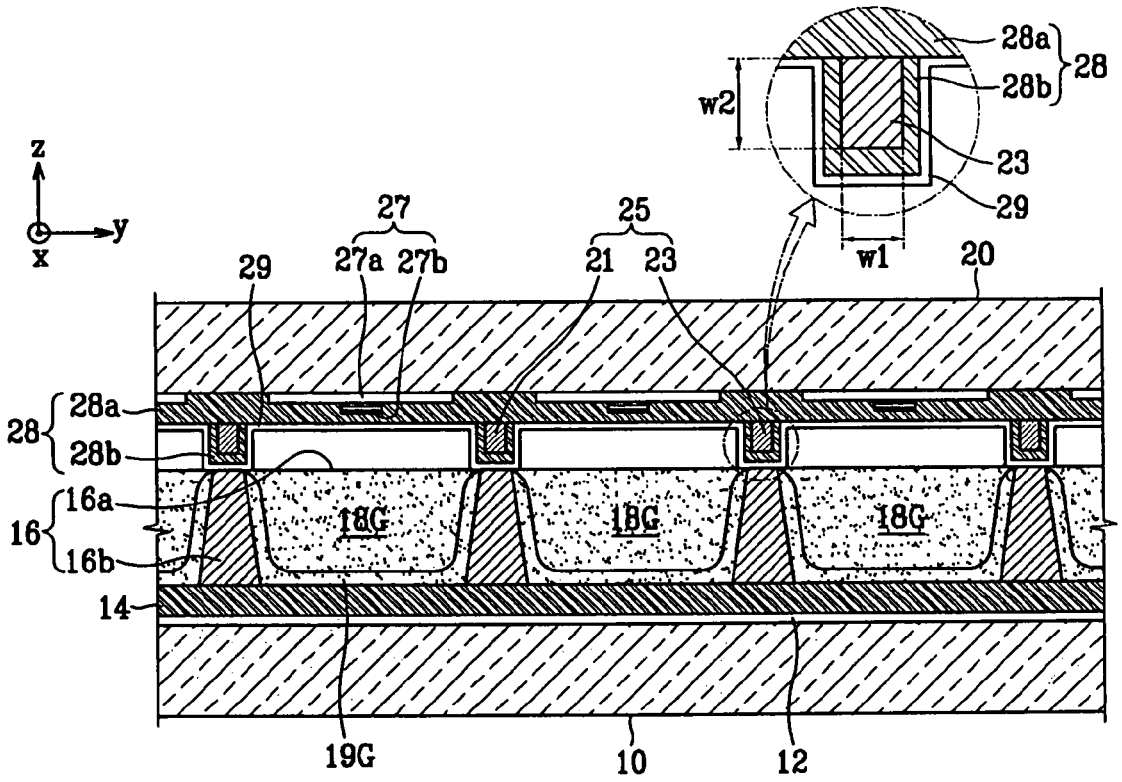
FIG. 3 is a fragmentary sectional view taken along line III-III of FIG. 1.

FIG.1 is a fragmentary, sectional exploded perspective view of a plasma display panel (PDP) according to a first exemplary embodiment of the present invention, FIG. 2 is a fragmentary plan view of the PDP of FIG. 1, and FIG. 3 is a fragmentary sectional view taken along line III-III of FIG. 1.

As shown in the drawings, the PDP of the first exemplary embodiment of the present invention includes a first substrate 10 (hereinafter referred to as a "rear substrate") and a second substrate 20 (hereinafter referred to as a "front substrate") mounted in opposition to one another with a predetermined gap therebetween. A plurality of discharge cells 18R, 18G, 18B are defined in the gap between the rear substrate 10 and front substrate 20 by barrier ribs 16. A discharge gas containing xenon (Xe) is filled between the rear substrate 10 and front substrate 20 so as to allow plasma discharge to take place.

A plurality of address electrodes 12 are formed on an inner surface of the rear substrate 10 along a first direction (direction y), and a main dielectric layer 14 is formed on the rear substrate 10 so as to cover the address electrodes 12. A predetermined spacing is provided between adjacent ones of the address electrodes 12.

The barrier ribs 16 are formed on the main dielectric layer 14. In the first exemplary embodiment, the barrier ribs 16 include first barrier rib members 16*a* extending in the first direction (direction y), and second barrier rib members 16*b* extending in a second direction (direction x) which is perpendicular to direction y. The barrier ribs 16 thereby independently define each of the discharge cells 18R, 18G, 18B. It is to be noted that the present invention is not limited to such a barrier rib structure, and an alternative striped configuration may be used in which barrier rib members are formed along the direction y alone. Still other configurations may be used.

With reference to FIG. 2, formed on an inner surface of the front substrate 20 opposing the rear substrate 10 are discharge sustain electrodes 25. Each of the discharge sustain electrodes 25 includes a first electrode (hereinafter referred to as an X electrode) 21 and a second electrode (hereinafter referred to as a Y electrode) 23. The X electrode 21 and Y electrode 23 are formed so as to extend along direction x. The discharge sustain electrodes 25 are involved in discharge during sustain intervals. Although the X electrode 21 and Y electrode 23 function so as to apply voltages required for discharge during sustain intervals, the operation thereof may be varied according to the discharge voltage applied to each of the X electrode 21 and Y electrode 23. Hence, the X electrode 21 and Y electrode 23 are not limited to such an operation during sustain intervals.

In the first exemplary embodiment, the X electrodes 21 and the Y electrodes 23 extend along direction x at areas corresponding to the second barrier rib members 16*b*. Accordingly, either an X electrode 21 or a Y electrode 23 is positioned between each pair of adjacent ones of the discharge cells 18R, 18G, 18B (i.e., adjacent along direction y). This allows for each of the X electrode 21 and Y electrode 23 to be used in common by adjacent ones of the discharge cells 18R, 18G, 18B.

Third electrodes (hereinafter referred to as M electrodes) 27 are respectively mounted between opposing pairs of the X electrodes 21 and Y electrodes 23. Each of the M electrodes 27 includes a bus electrode 27*b* extending along the direction x and crossing over the discharge cells 18R, 18G, 18B, and a plurality of protruding electrodes 27*a* extending from the bus electrode 27*b* toward the X electrodes 21 and Y electrodes 23. The protruding electrodes 27*a* are preferably made of a transparent material, such as ITO (indium tin oxide), so as to ensure a high aperture ratio, while the bus electrodes 27*b* are preferably made of a metal material so as to compensate for the high resistance of the protruding electrodes 27*a*.

Ends of the protruding electrodes 27*a* are respectively formed into enlarged sections 27*a'*, which extend in the direction x to a length, in the same direction, that is greater than an area of the protruding electrodes 27*a* that overlaps the bus electrodes 27*b* (i.e., a width of the remainder of the protruding electrodes 27*a*). The enlarged sections 27*a'* allow for easy discharge firing between the M electrodes 27 and the discharge sustain electrodes 25.

The M electrodes 27 may be involved in reset discharge during reset intervals, and may be involved in selecting discharge cells to be illuminated while effecting address discharge between the address electrodes 12 in addressing intervals. However, these functions of the M electrodes 27 may vary according to the discharge voltage applied to each electrode, and thus the M electrodes 27 are not limited in this respect.

Referring to FIG. 3, the X electrodes 21 and the Y electrodes 23 are positioned further from the front substrate 20 in the direction z, which is perpendicular to the directions x and y, than the M electrodes 27. A spacing is provided between the X electrodes 21 and Y electrodes 23, and an opposing discharge may be induced between adjacent and opposing ones of the X electrodes 21 and Y electrodes 23.

Each of the X electrodes 21 and Y electrodes 23 may be formed such that a dimension (w2) thereof in the direction z is greater than a dimension (w1) in the direction y. That is, the height of the X electrodes 21 and Y electrodes 23 may be made greater than a width thereof. As a result, when it is necessary to reduce the size of discharge cells in a planar direction to in order to obtain a high density display, the increased height of the X electrodes 21 and Y electrodes 23 compensates for such a change in dimensions.

In the first exemplary embodiment, the X electrodes 21 and Y electrodes 23 are formed on a layer different from that on which the M electrodes 27 are formed. That is, a first dielectric layer 28*a* is formed on the front substrate 20 covering the M electrodes 27, the X electrodes 21 and Y electrodes 23 are formed on the first dielectric layer 28*a*, and a second dielectric layer 28*b* is formed surrounding the X electrodes 21 and Y electrodes 23. The first dielectric layer 28*a* and second dielectric layer 28*b* may be made of the same material. The X electrodes 21 and Y electrodes 23 are preferably made of metal.

An MgO protection layer 29 is formed on the first dielectric layer 28*a* and second dielectric layer 28*b*. The MgO protection layer 29 is able to protect the first dielectric layer 28*a* and second dielectric layer 28*b* from collisions with ionized atomic ions during plasma discharge. Further, since the MgO protection layer 29 has a high emission coefficient with respect to secondary electrons when struck with ions, the MgO protection layer 29 is able to enhance discharge efficiency.

With the PDP according to the first exemplary embodiment of the present invention described above, address discharge is performed during addressing intervals by opposing discharge occurring between the M electrodes 27 and the address electrodes 12. Further, during sustain intervals, sustain discharge is performed by opposing discharge occurring between the X electrodes 21 and Y electrodes 23. As a result, a higher illumination efficiency can be obtained as compared to that obtained by a conventional surface discharge structure.

Furthermore, the problems associated with the conventional surface discharge structure and resulting from reducing discharge cell size to obtain a high density (i.e., reduction in illumination efficiency and brightness, and increase in discharge firing voltage) are overcome.

A drive waveform that may be applied to the PDP of the first exemplary embodiment will now be described.

Figure 4:
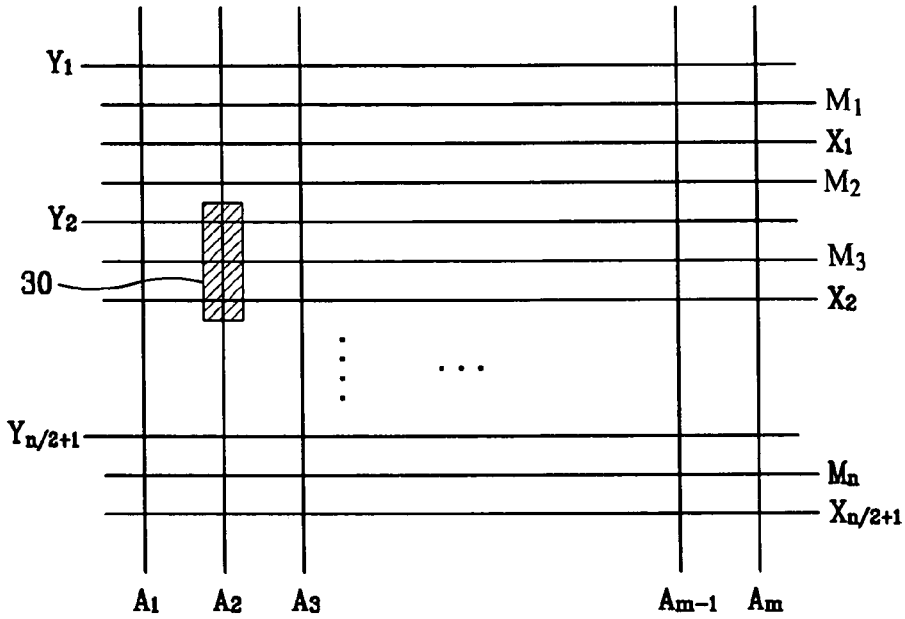
FIG. 4 is a schematic view illustrating an electrode arrangement of the plasma display panel of FIG. 1.

FIG. 4 is a schematic view illustrating an electrode arrangement of the PDP of FIG. 1.

As shown in FIG. 4, address electrodes (A1 . . . Am) are arranged in parallel columns, while n/2+1 rows of Y electrodes (Y1 . . . Yn/2+1), X electrodes (X1 . . . Xn/2+1), and n rows of M electrodes (M1 . . . Mn) are arranged in horizontal rows. That is, one of the M electrodes is positioned between adjacent pairs of the X and Y electrodes, and a four-electrode structure is realized for each of the discharge cells 18 of one of each of the X, Y, M, and address electrodes.

The X and Y electrodes function primarily as electrodes for applying a sustain discharge voltage waveform, and the M electrodes function primarily to apply reset and scan pulse voltage waveforms.

Figure 5:
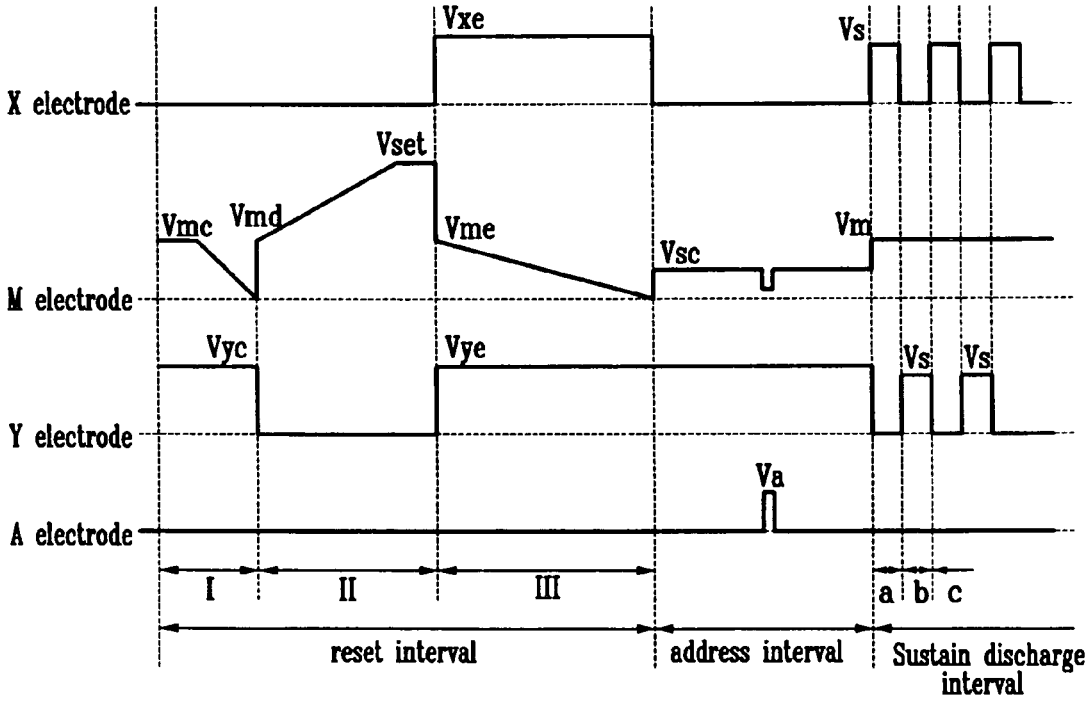
FIG. 5 is a drive waveform diagram of the plasma display panel of FIG. 1.

FIG. 5 is a drive waveform diagram of the plasma display panel of FIG. 1, and FIGS. 6A through 6E are schematic views illustrating wall charge distribution based on the drive waveforms of the PDP of FIG. 1. A drive method according to an exemplary embodiment of the present invention will now be described with reference to FIGS. 5 and 6A through 6E.

In the drive method of the present invention, each subfield is divided into a reset interval, an address interval, and a sustain discharge interval. The reset interval is further divided into sub-intervals referred to as an elimination interval, an M electrode rise waveform interval, and an M electrode fall waveform interval.

Elimination Interval (I)

Figure 6A:
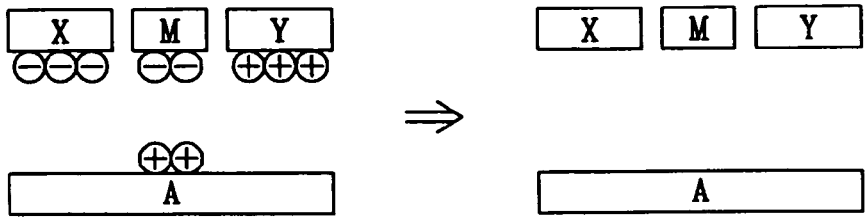
FIGS. 6A through 6E are schematic views illustrating wall charge distribution based on the drive waveforms of the PDP of FIG. 1.

In elimination interval (I), wall charges formed in a previous sustain discharge interval are eliminated. In the exemplary embodiment, a sustain discharge pulse is applied to the X electrodes, and a voltage smaller than that applied to the X electrodes is applied to the Y electrodes (e.g., a ground voltage) at the end of the sustain discharge interval. As a result, (+) wall charges are formed on the Y electrodes and the address electrodes, and (−) wall charges are formed on the X electrodes and the M electrodes, as shown in FIG. 6A.

In the elimination interval (I), in a state where the Y electrodes are biased by a voltage (Vyc), a waveform is applied to the M electrodes, which waveform is gradually reduced from a voltage (Vmc) to a ground voltage (a ramp or log waveform). As a result, wall charges applied during the sustain discharge interval are eliminated as shown in FIG. 6A.

M Electrode Rise Waveform Interval (II)

Figure 6B:
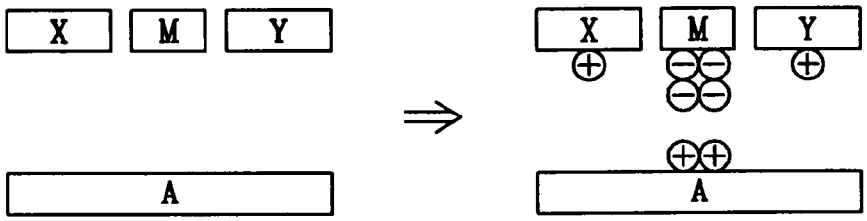

During the M electrode rise waveform interval (II), in a state where the X and Y electrodes are biased by a ground voltage, a waveform is applied to the M electrodes, which waveform is gradually raised from a voltage (Vmd) to a voltage (Vset) (a ramp or log waveform). While this rise waveform is being applied, a weak reset discharge occurs in all the discharge cells from the M electrodes to each of the address electrodes, the X electrodes, and the Y electrodes. As a result, (−) wall charges are accumulated on the M electrodes, while (+) wall charges are accumulated on the address, X, and Y electrodes, as shown in FIG. 6B.

M Electrode Fall Waveform Interval (III)

Subsequently, in a latter part of the reset interval, in a state where the X electrodes and the Y electrodes are respectively biased by a voltage (Vxe) and a voltage (Vye), a waveform is applied to the M electrodes, which waveform is gradually reduced from a voltage (Vme) to a ground voltage (a ramp or log waveform). Preferably, in order to allow circuit structure to be simplified, the following conditions are satisfied: Vxe=Vye and Vmd=Vme. However, the present invention is not limited in this respect.

While this ramp voltage is reduced, a weak reset discharge occurs in all of the discharge cells. Since the M electrode fall waveform interval is used to slowly reduce the wall charges accumulated during the M electrode rise waveform interval, an increase in the time of the fall waveform (i.e., a reduction in the sharpness of the downward slant) allows for more precise control of wall charge reduction. Such a waveform is advantageous with respect to address discharge.

Figure 6C:
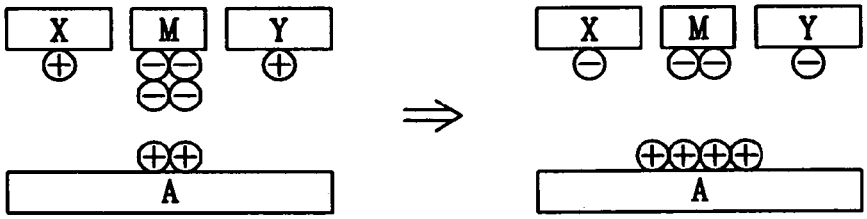

By applying the fall waveform to the M electrodes, the wall charge accumulated on each electrode in all the cells is evenly eliminated. As shown in FIG. 6C, (+) wall charges are accumulated on the address electrodes, while (−) wall charges are accumulated on the X, Y, and M electrodes.

(2) Address Interval (Scan Interval)

During the address interval, in a state where a plurality of the M electrodes are biased by a voltage (Vsc), a scan voltage (for example, a ground voltage) is consecutively applied to the M electrodes so as to apply a scan pulse. Simultaneously, an address voltage is applied to the address electrodes in cells in which discharge is desired (i.e., cells to be turned on). At this point, a ground voltage is applied to the X electrodes and the voltage (Vye) is applied to the Y electrodes. That is, a voltage is applied to the Y electrodes, that voltage being higher than the voltage applied to the X electrodes.

Figure 6D:
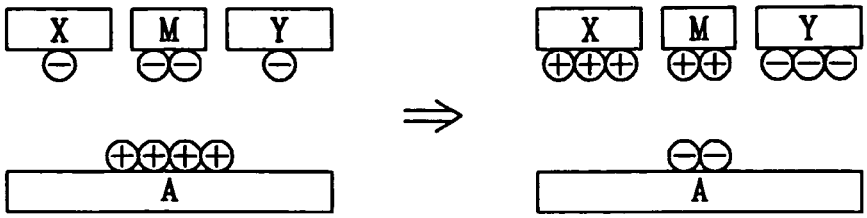

As a result, discharge occurs between the M electrodes and the address electrodes, and the discharge expands toward the X and Y electrodes. Hence, as shown in FIG. 6D, (+) wall charges accumulate on the X and M electrodes, while (−) wall charges accumulate on the Y electrodes and the address electrodes.

(3) Sustain Discharge Interval

In the sustain discharge interval, according to this embodiment of the invention, in a state where the M electrodes are biased by a sustain discharge voltage (Vm), a sustain discharge voltage pulse is alternately applied to the X and Y electrodes. As a result of such application of voltages, sustain discharge occurs in the discharge cells selected in the address interval.

In this embodiment, discharge at the start of sustain discharge differs from discharge during normal sustain discharge. In the following description, discharge occurring at the start of sustain discharge will be referred to as that occurring during a short-gap discharge interval, while discharge occurring during normal discharge will be referred to as that occurring during a long-gap discharge interval.

(3-1) Short Gap Discharge Interval

Figure 6E:
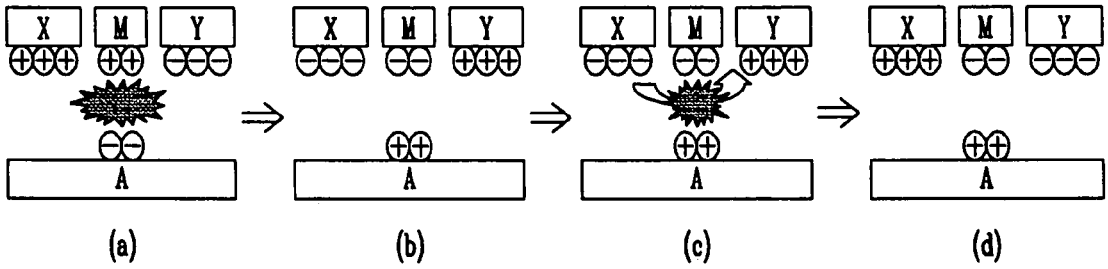

At the start of sustain discharge, with reference to FIG. 6E, parts (a) and (b), a (+) pulse voltage is applied to the X electrodes and a (−) pulse voltage is applied to the Y electrodes.

In this discussion, (+) and (−) merely indicate relative magnitudes. Hence, application of (+) and (−) pulse voltages to the X and Y electrodes, respectively, indicates that a larger pulse voltage is applied to the X electrodes than to the Y electrodes.) At the same time that a (+) pulse voltage is applied to the X electrodes and a (−) pulse voltage is applied to the Y electrodes, a (+) pulse voltage is applied to the M electrodes. Accordingly, unlike prior arrangements wherein discharge occurs only between the X and Y electrodes, discharge in the present invention occurs between the X/M electrodes and the Y electrodes. According to this embodiment, since the distance between the M electrodes and the Y electrodes is less than the distance between the X and Y electrodes, the electric field applied between the M and Y electrodes is greater. As a result, discharge between the M and Y electrodes plays a significantly larger role than discharge between the X and Y electrodes. This discharge between the M and Y electrodes is referred to as the short-gap discharge.

Therefore, with the generation of short-gap discharge, wherein a relatively large electric field is applied at the start of sustain discharge, even if a sufficient priming particle is not generated in the discharge cells when a sustain discharge pulse is first applied following the address interval, sufficient discharge may nevertheless occur.

(3-2) Long-Gap Discharge Interval

Following the application of the first sustain discharge pulse of the sustain discharge interval, since the M electrodes are biased to a fixed voltage (Vm), discharge between the M and X electrodes and between the M and Y electrodes (i.e., short-gap discharge) contributes little to discharge. Accordingly, main discharge is that between the X and Y electrodes such that images inputted by discharge pulse numbers applied alternately to the X and Y electrodes may be displayed.

That is, with reference to FIG. 6E, part (d), during the sustain discharge interval in a normal state, (−) wall charges are continuously accumulated on the M electrodes, and (−) and (+) wall charges are alternately accumulated on the X and Y electrodes.

In this embodiment, since discharge occurs by short-gap discharge between the X and M electrodes (or the Y and M electrodes) at the start of sustain discharge, sufficient discharge occurs, even in a state of limited priming particles. Furthermore, discharge occurs by long-gap discharge between the X and Y electrodes in a normal state. Therefore, stable discharge is realized.

In addition, according to this embodiment, since substantially symmetrical voltage waveforms are applied to the X and Y electrodes, the circuits used to drive the X and Y electrodes may be identically designed to a substantial extent. This allows for a difference in circuit impedance between the X and Y electrodes to be almost completely removed so that distortion in the pulse waveforms applied to the X and Y electrodes during the sustain discharge interval may be reduced, ultimately allowing for stable discharge.

According to the first exemplary embodiment of the present invention, the waveforms of the X and Y electrodes may be exchanged without affecting drive performance. This is also the case during the address interval.

According to the drive method of the first exemplary embodiment described above, a reset waveform and a scan pulse waveform are applied to the M electrodes, and a sustain voltage waveform is applied to the X and Y electrodes. In addition to the reset waveform shown in FIG. 5, reset waveforms of various types may be applied to the M electrodes.

Figure 7:
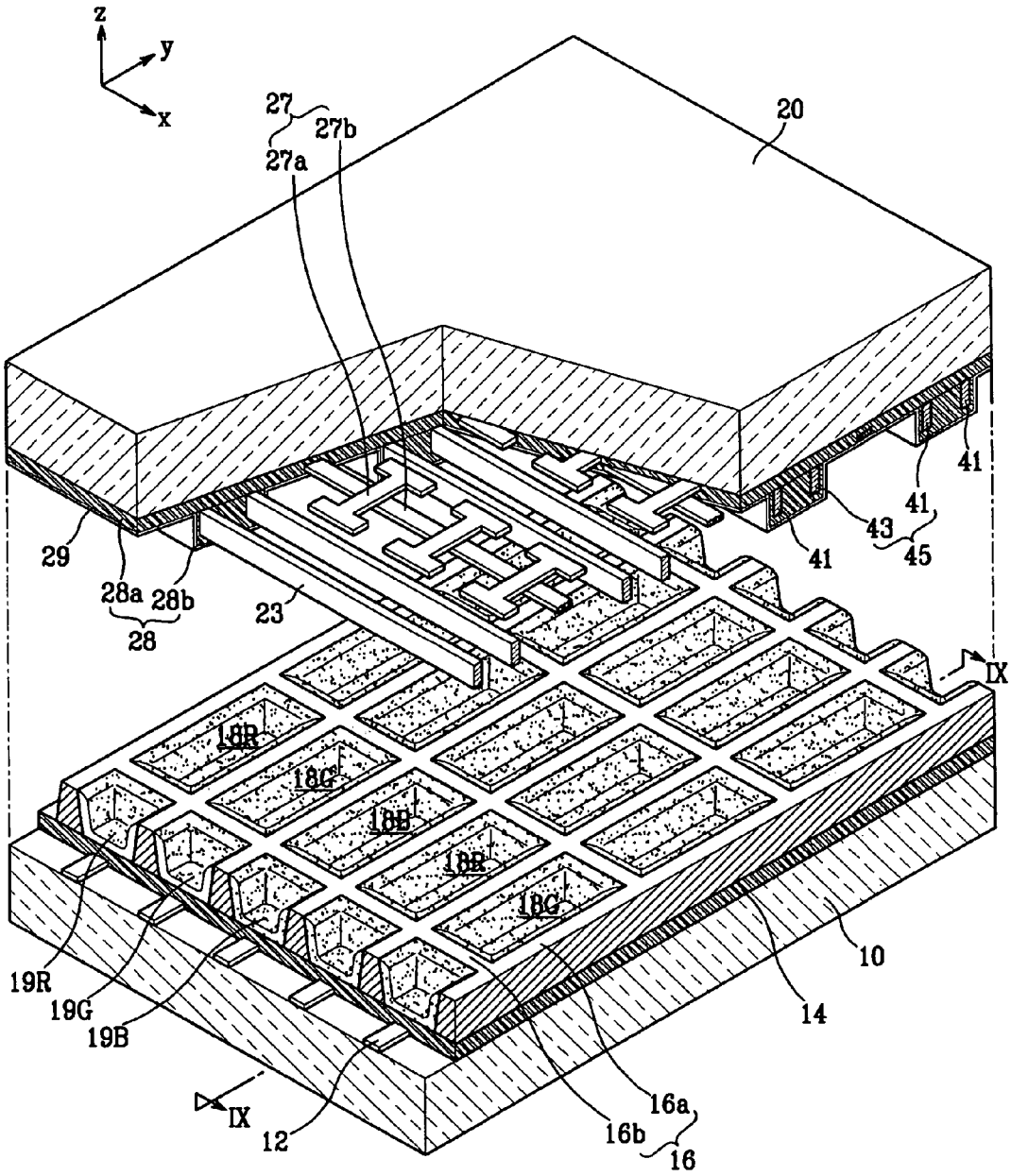
FIG. 7 is a fragmentary, sectional exploded perspective view of a plasma display panel according to a second exemplary embodiment of the present invention.
Figure 8:
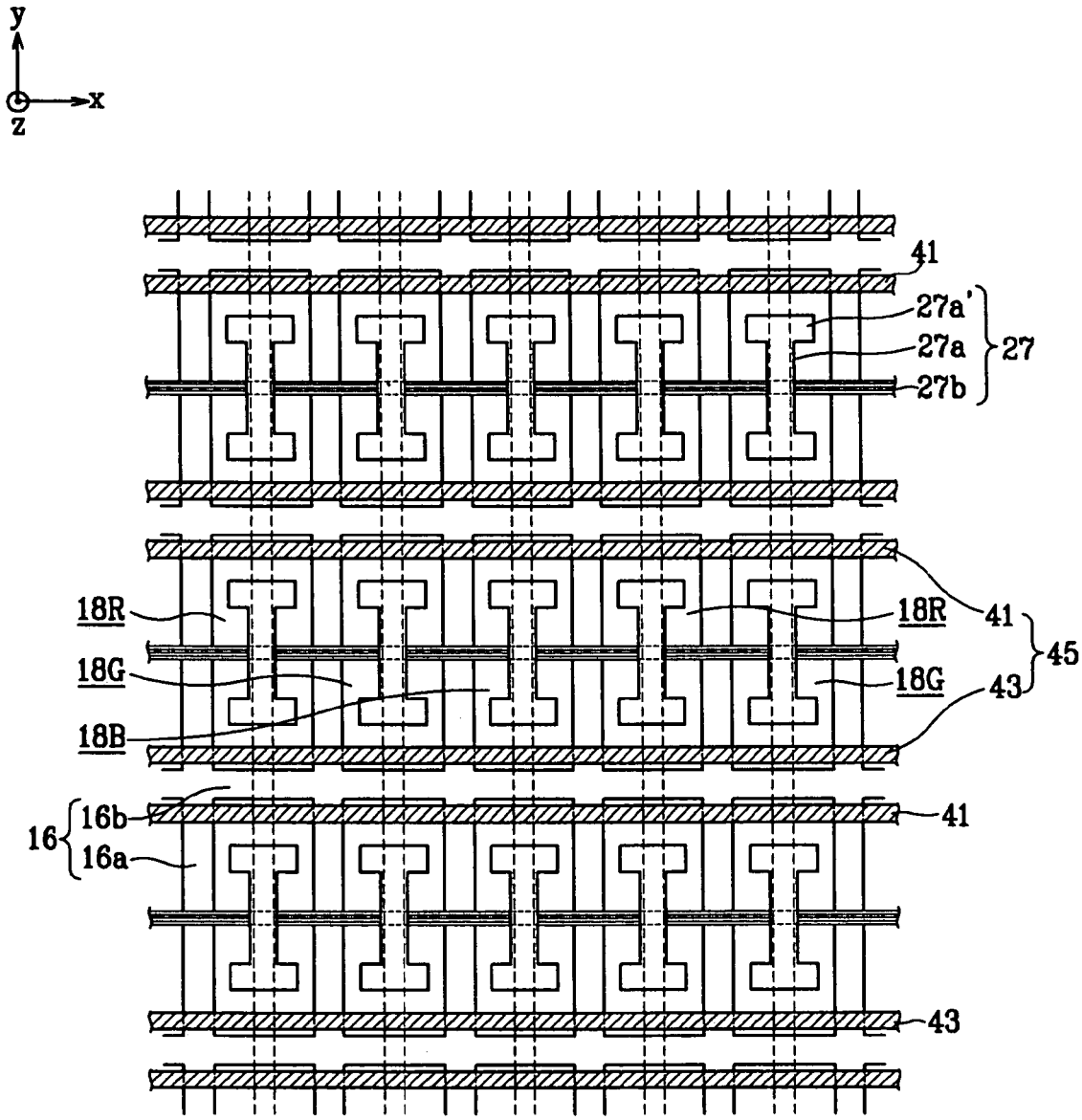
FIG. 8 is a fragmentary plan view of the plasma display panel of FIG. 7.
Figure 9:
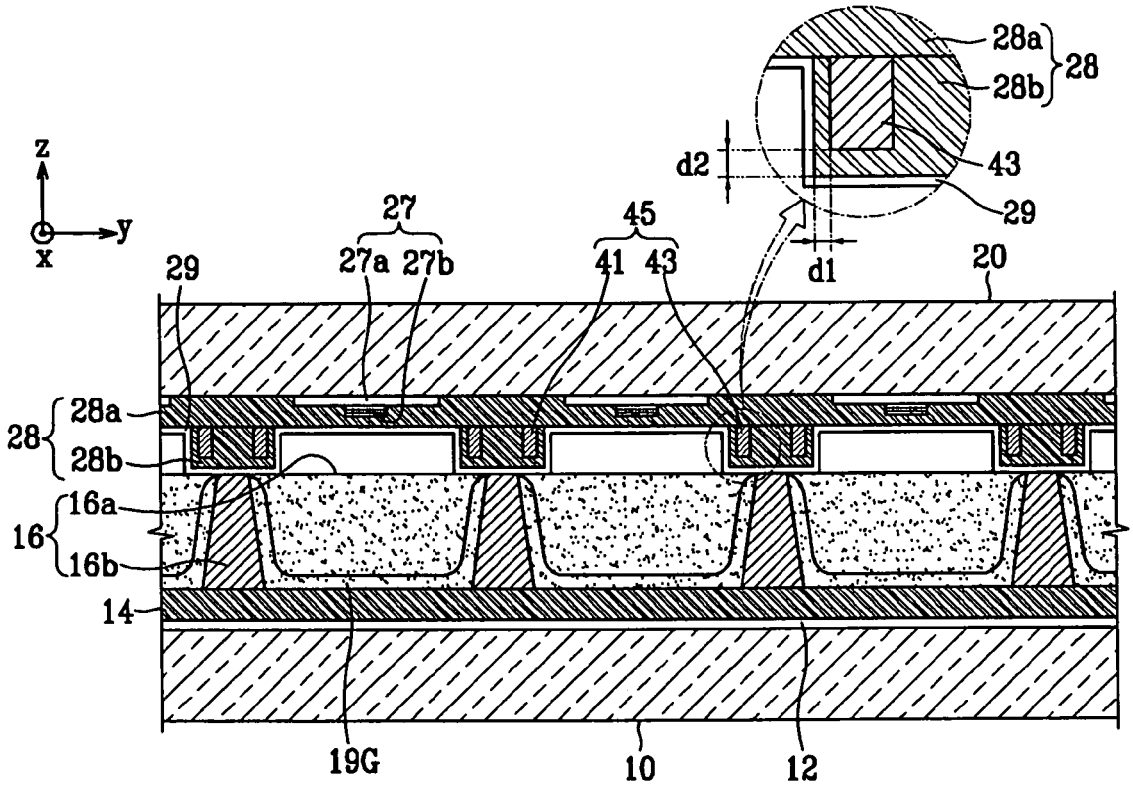
FIG. 9 is fragmentary sectional view taken along line IX-IX of FIG. 7.

FIG. 7 is a fragmentary, sectional exploded perspective view of a PDP according to a second exemplary embodiment of the present invention, FIG. 8 is a fragmentary plan view of the PDP of FIG. 7, and FIG. 9 is fragmentary sectional view taken along line IX-IX of FIG. 7.

The PDP according to the second exemplary embodiment has the same basic structure as that of the first exemplary embodiment. Particular attention will be given to aspects of the second embodiment which are different from those of the first exemplary embodiment.

In this embodiment, X electrodes 41 and Y electrodes 43 are mounted in opposing pairs for each of the discharge cells 18R, 18G, 18B. Each pair of one of the X electrodes 41 and one of the Y electrodes 43 is formed so as to overlap a row of the discharge cells 18R, 18G, 18B formed along direction x. Therefore, adjacent ones of the discharge cells 18R, 18G, 18B along direction y have different discharge sustain electrodes 45 associated therewith. Furthermore, the M electrodes 27 are mounted between respective pairs of one of the X electrodes 41 and one of the Y electrodes 43. The M electrodes 27 are respectively formed so as to intersect the discharge cells 18R, 18G, 18B, and fully within the same (i.e., not extending to non-discharge regions between the X electrodes 41 and Y electrodes 43 over the second barrier rib members 16*b*).

With reference to FIG. 9, the X electrodes 41 and Y electrodes 43 are displaced further from the front substrate 20 along direction z than the M electrodes 27 are. A spacing is provided between the X electrodes 41 and Y electrodes 43, and an opposing discharge may be induced between adjacent and opposing ones of the X electrodes 41 and Y electrodes 43.

Furthermore, the X electrodes 41 and Y electrodes 43 are formed on a layer different from that on which the M electrodes 27 are formed. That is, the first dielectric layer 28*a* is formed on the front substrate 20 covering the M electrodes 27, the X electrodes 41 and Y electrodes 43 are formed on the first dielectric layer 28*a*, and the second dielectric layer 28*b* is formed surrounding the X electrodes 41 and Y electrodes 43. The first dielectric layer 28*a* and second dielectric layer 28*b* may be made of the same material. The X electrodes 41 and Y electrodes 43 are preferably made of metal.

With reference to FIG. 9, during formation of the second dielectric layer 28*b* such that the X electrodes 41 and Y electrodes 43 are surrounded by layer 28*b*, a thickness (d2) of the second dielectric layer 28*b* in a direction toward the rear substrate 10 is greater than a thickness (d1) of the second dielectric layer 28*b* in a direction toward the X electrodes 41 and Y electrodes 43 (i.e., along direction y). Through the use of this structure, mis-discharge between electrodes of adjacent discharge cells may be prevented during sustain discharge.

The drive waveform shown in FIG. 5 may be applied to the second exemplary embodiment.

Figure 10:
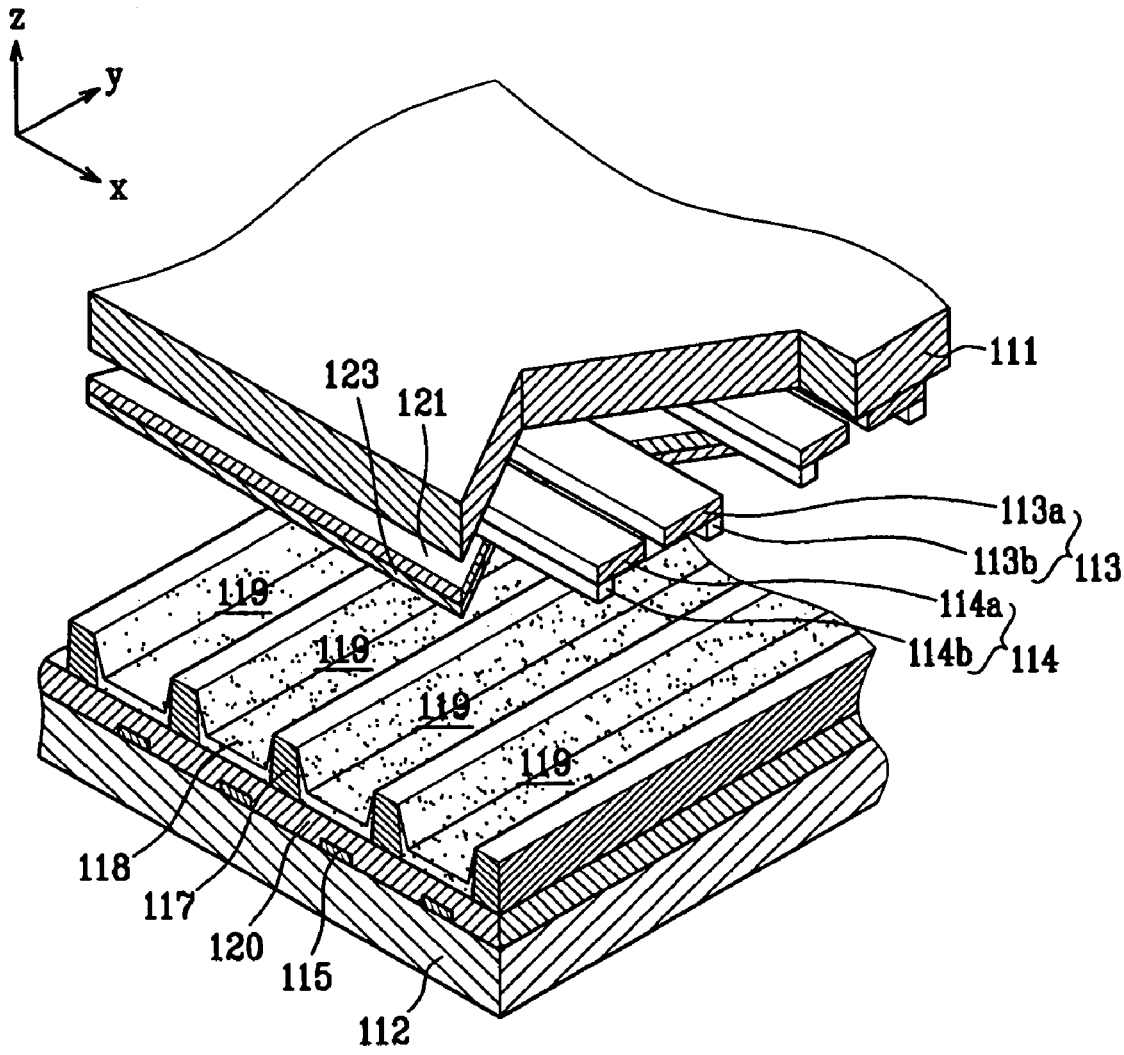
FIG. 10 is a fragmentary, sectional exploded perspective view of a plasma display panel.

Referring to FIG. 10, in an AC PDP having a triode surface discharge structure, address electrodes 115 are formed in one direction (i.e., along direction y) on a rear substrate 112, and a first dielectric layer 120 is formed on the rear substrate 112 so as to cover the address electrodes 115. Barrier ribs 117 are formed on the first dielectric layer 120 defining a plurality of discharge cells 119. The barrier ribs 117 may be formed in a stripe pattern along direction y and at areas between the address electrodes 115. It is also possible to utilize other configurations, such as a matrix pattern, in which the barrier ribs are formed in an intersecting lattice pattern in both directions x and y. Red, green, and blue phosphor layers 118 are respectively formed in the discharge cells 119 defined by the barrier ribs 117.

Formed on a surface of a front substrate 111, opposing the rear substrate 112, are a plurality of discharge sustain electrodes 113 and 114, which extend in direction x, and which are formed into pairs consisting of one of the discharge sustain electrodes 113 and one of the discharge sustain electrodes 114. Each of the discharge sustain electrodes 113 includes a transparent electrode 113*a* and a bus electrodes 113*b* formed on the transparent electrode 113*a*, and each of the discharge sustain electrodes 114 includes a transparent electrode 114*a* and a bus electrode 114*b* formed on the transparent electrode 114*a*. A second dielectric layer 121 and an MgO protection layer 123 are formed on the front substrate 111 (in that order) so as to cover the discharge sustain electrodes 113 and 114.

Each area between one of the address electrodes 115 and a pair of the discharge sustain electrodes 113 and 114, and delimited by the intersection of these elements, corresponds to a position of one of the discharge cells 119.

In the PDP of the present invention described above, address discharge occurs as a result of opposing discharge between the M electrodes and the address electrodes in the addressing interval. Furthermore, sustain discharge occurs as a result of opposing discharge between opposing ones of the X and Y electrodes in the sustain interval. As a result, a higher illumination efficiency is obtained as compared to that obtained by the conventional surface discharge structure. In addition, the problems encountered in the conventional surface discharge structure as a result of reducing discharge cell size in an effort to obtain higher density (i.e., reduction in illumination efficiency and brightness, and increase in discharge firing voltage) are overcome.

Although embodiments of the present invention have been described in detail hereinabove, it should be clearly understood that many variations and/or modifications of the basic inventive concepts herein taught may appear to those skilled in the present art but will still fall within the spirit and scope of the present invention, as defined in the appended claims.

What is claimed is:

1. A plasma display panel, comprising:

a first substrate and a second substrate provided in opposition to one another with a predetermined gap therebetween;

a plurality of address electrodes formed on the first substrate in a first direction;

a plurality of barrier ribs mounted in the gap between the first and second substrates so as to define a plurality of discharge cells;

a plurality of phosphor layers respectively formed in the discharge cells;

a plurality of first and second electrodes formed on the second substrate in a second direction which is substantially perpendicular to the first direction, the first and second electrodes corresponding to each of the discharge cells;

a plurality of third electrodes respectively mounted between the first and second electrodes at positions corresponding to the discharge cells; and a first dielectric layer and a second dielectric layer, the first dielectric layer being formed on the second substrate so as to cover the third electrodes, the first and second electrodes being formed on the first dielectric layer, the second dielectric layer being connected to the first dielectric layer and being formed so as to surround each of the first and second electrodes.

2. The plasma display panel of claim 1, wherein the first and second electrodes are formed on a layer different from a layer on which the third electrodes are formed.

3. The plasma display panel of claim 1, wherein the first and second electrodes have a length in a direction perpendicular to the first and second substrates that is greater than a length in a direction parallel to the first and second substrates.

4. The plasma display panel of claim 1, wherein the first and second electrodes are made of metal.

5. The plasma display panel of claim 1, wherein the first and second electrodes extend over areas corresponding to the discharge cells.

6. The plasma display panel of claim 1, wherein the first and second electrodes are positioned further from the second substrate than the third electrodes are positioned, and a spacing is provided between the first and second electrodes so that the first and second electrodes oppose one another.

7. A plasma display panel, comprising:

a first substrate and a second substrate provided in opposition to one another with a predetermined gap therebetween;

a plurality of address electrodes formed on the first substrate in a first direction;

a plurality of barrier ribs mounted in the gap between the first and second substrates so as to define a plurality of discharge cells;

a plurality of phosphor layers respectively formed in the discharge cells;

a plurality of first and second electrodes formed on the second substrate in a second direction which is substantially perpendicular to the first direction, the first and second electrodes corresponding to each of the discharge cells;

a plurality of third electrodes respectively mounted between the first and second electrodes at positions corresponding to the discharge cells; and a first dielectric layer and a second dielectric layer, the first dielectric layer being formed on the second substrate so as to cover the third electrodes, the first and second electrodes being formed on the first dielectric layer, the second dielectric layer being formed so as to surround each of the first and second electrodes;

wherein a thickness of the second dielectric layer formed on a surface opposing the first and second electrodes is less than a thickness of the second dielectric layer formed on a surface facing the first and second electrodes.

8. The plasma display panel of claim 7, wherein the first and second electrodes are positioned further from the second substrate than the third electrodes are positioned, and a spacing is provided between the first and second electrodes so that the first and second electrodes oppose one another.

9. A plasma display panel, comprising:

a first substrate and a second substrate provided in opposition to one another with a predetermined gap therebetween;

a plurality of address electrodes formed on the first substrate in a first direction;

a plurality of barrier ribs mounted in the gap between the first and second substrates so as to define a plurality of discharge cells;

a plurality of phosphor layers respectively formed in the discharge cells;

a plurality of first and second electrodes formed on the second substrate in a second direction which is substantially perpendicular to the first direction, the first and second electrodes corresponding to each of the discharge cells; and a plurality of third electrodes respectively mounted between the first and second electrodes at positions corresponding to the discharge cells;

wherein the third electrodes comprise bus electrodes extending in the second direction and intersecting the discharge cells, and protruding electrodes extending from the bus electrodes toward the first and second electrodes.

10. The plasma display panel of claim 9, wherein the protruding electrodes include enlarged sections formed at ends thereof in proximity to the first and second electrodes.

11. The plasma display panel of claim 9, wherein the first and second electrodes are positioned further from the second substrate than the third electrodes are positioned, and a spacing is provided between the first and second electrodes so that the first and second electrodes oppose one another.

12. A plasma display panel, comprising:

a first substrate and a second substrate provided in opposition to one another with a predetermined gap therebetween;

a plurality of address electrodes formed on the first substrate in a first direction;

a plurality of barrier ribs mounted in the gap between the first and second substrates so as to define a plurality of discharge cells;

a plurality of phosphor layers respectively formed in the discharge cells;

a plurality of first and second electrodes formed on the second substrate in a second direction which is substantially perpendicular to the first direction, the first and second electrodes corresponding to each of the discharge cells; and a plurality of third electrodes respectively mounted between the first and second electrodes at positions corresponding to the discharge cells;

wherein the barrier ribs comprise first barrier rib members extending in the first direction, and second barrier rib members extending in the second direction and intersecting the first barrier rib members so as to define each of the discharge cells; and wherein each of the first and second electrodes is mounted so as to extend over one of the second barrier rib members so that pairs of the discharge cells which are adjacent in the first direction share one of the first and second electrodes in common.

13. The plasma display panel of claim 12, wherein the first and second electrodes are positioned further from the second substrate than the third electrodes are positioned, and a spacing is provided between the first and second electrodes so that the first and second electrodes oppose one another.

* * * * *